United States Patent [19]

Shimizu

[11] 4,362,797

[45] Dec. 7, 1982

[54] ELECTROPHOTOGRAPHC PROCESS TO RELEASE TRAPPED CHARGES BY CHARGING AND ULTRAVIOLET EXPOSURE

[75] Inventor: Akira Shimizu, Fuchu, Japan

[73] Assignee: Olympus Optical Company Limited, Tokyo, Japan

[21] Appl. No.: 211,413

[22] Filed: Nov. 26, 1980

Related U.S. Application Data

[63] Continuation of Ser. No. 961,033, Nov. 15, 1978, abandoned.

[30] Foreign Application Priority Data

Nov. 22, 1977 [JP] Japan ..... 52-140260

[51] Int. Cl.[3] ..... G03G 5/14; G03G 13/24

[52] U.S. Cl. ..... 430/55; 430/60; 430/125

[58] Field of Search ..... 430/55, 67, 81, 125

[56] References Cited

U.S. PATENT DOCUMENTS 3,776,627 12/1973 Ohnishi et al. ..... 430/67

3,834,809 9/1974 Yoshizawa ..... 430/58

*Primary Examiner*—John E. Kittle

*Assistant Examiner*—John L. Goodrow

*Attorney, Agent, or Firm*—Fleit & Jacobson

[57] ABSTRACT

An electrophotographic process comprising the steps of providing a composite photosensitive member consisting of a conductor, an intermediate layer of organic insulator, a photoconductive semiconductor layer as a charge generating layer formed on the conductor and a transparent photo semiconductor layer as a charge retentive and transporting layer; forming on the composite photosensitive member an electrostatic latent image corresponding to an image of a document to be copied; obtaining desired number of duplicated copies; uniformly charging the composite photosensitive member simultaneously with or before exposing ultraviolet rays on the composite photosensitive member to release charges trapped in the composite member.

3 Claims, 8 Drawing Figures

ELECTROPHOTOGRAPHC PROCESS TO RELEASE TRAPPED CHARGES BY CHARGING AND ULTRAVIOLET EXPOSURE

This is a continuation of application Ser. No. 961,033 filed Nov. 15, 1978 now abandoned.

BACKGROUND OF THE INVENTION

The present invention relates to an electrophotographic process in which a composite photosensitive member is used.

A composite photosensitive member for use in the electrophotographic process is generally formed by applying on a conductive carrier a photoconductive semiconductor having a charge generating function by light image projection and a transparent photo semiconductor having charge retentivetransport function in order. Japanese Patent Application Publication Nos. 16,198/68 and 5,349/70 and U.S. Pat. No. 3,725,058 disclose a composite photosensitive member in which a pure Se or a Se having doped Te or As for improving light sensitivity, particularly, color sensitivity is used as photoconductive semiconductor and polyvinylcarbazoles vinyl polymers are used as transparent photo semiconductor. Japanese Pat. Laid-opened No. 67,660/75 discloses a composite photosensitive member in which CdS, ZnCdS, etc. are used as photoconductive semiconductor. Japanese patent application Publication No. 14,272/74 discloses a composite photosensitive member in which a film layer such as epoxy resin, polyurethane resin, silicone resin is interposed between a conductive carrier member and a photoconductive semiconductor in order to emphasize a combining force of these members. Japanese patent application Publication No. 26,148/74 discloses a composite photosensitive member in which a film layer of high resistivity semiconductor consisting of Se of high purity, $As_2S_3$ is interposed between a conductive carrier member and a photoconductive semiconductor in order to improve charging characteristic and dark decay characteristic.

According to the experiment of the present inventor, however, there is found that following problems arise for the above described composite photosensitive member (1) If the composite photosensitive member is subjected to charging and exposure processes repeatedly the dark decay becomes large and the amount of residual charges become increased so that charged potential becomes decreased.

(2) If amorphous Se having Te etc. added thereto for increasing sensitivity is used as photoconductive semiconductor the tendency of the above term (1) becomes further increased.

The above described composite photosensitive member is applied to an electrophotographic apparatus for carrying out, for example, Carlson process, therefore, a fogging is generated on a duplicated copy in case of repeated utilization and the contrast of the image is largely decreased. If the above composite photosensitive member is applied to an electrophotographic apparatus in which a plurality of duplicated copies are obtained by repeating the development and transfer steps without destroying electrostatic latent image once formed by only one exposure the concentration of the duplicated copy becomes lower as the dark decay is increased, so that even though such low concentration is compensated the excellent result can not be obtained since the compensating condition is not constant.

That is, in the electrophotographic apparatus for forming duplicated copy with the use of the composite photosensitive member following conditions are required.

(1) Dark decay is very small, (2) Residual potential at bright portion of the light image is low.

(3) Exhausted phenomenon by repeating charging and exposure steps, that is, increasing of dark decay, lowering of charged potential and increasing of residual potential should not be large.

Means for making dark decay small is as follows.

(i) A method of making the amount of impurities in the photoconductive semiconductor small. For example, in case of using amorphous Se as photoconductive semiconductor it should be used one having high purity of more than 99.999%. However, high purity Se has color sensitivity only at shorter wavelength than that of blue color so that in fact its color sensitivity must be increased by doping and thus doping must be effected to increase sensitivity. Therefore, decrease of dark decay and increase of light sensitivity and color sensitivity are contrary to each other.

(ii) A method of controlling injection of charges into photoconductive semiconductor from conductor with the use of electrical barrier formed between the conductor and the photoconductive semiconductor by interposing organic insulator or inorganic high resistive semiconductor therebetween or barrier potential formed by contacting the photoconductive semiconductor with the conductor of which its material is selected to form barrier potential. In this method if the amount of the barrier potential is selected to a high value the dark decay can be made small. However, if the amount of the barrier potential is made too high resulting in obtaining of high residual potential at bright area in the light image projection the electrostatic contrast becomes lower. In particular, in case of repeating charging and exposure steps charges accumulated in the photoconductive semiconductor are increased and the residual potential is increased to a value not used in practical by repeating charging and exposure steps few times to dozens of times. In addition the dark decay is abrupty increased due to release of charges accumulated in the photoconductive semiconductor.

As described above, decrease of dark decay, increase of light sensitivity and color sensitivity, and decrease of residual potential are contrary to each other, but even if both characteristics are sufficient with each other and a composite photosensitive member having small dark decay and low residual potential is obtained the initial characteristic can not be maintained due to fatigued phenomenon by repeated utilization and thus durability thereof becomes short.

SUMMARY OF THE INVENTION

An object of the present invention is to eliminate the above described drawbacks.

Another object of the present invention is to provide an electrophotographic process in which in repeated utilization the initial characteristic of the composite photosensitive member can be maintained by efficiently preventing generation of the above described fatigued phenomenon and thus duplicated copies having excellent image quality can always be obtained.

A further object of the present invention is to provide an electrophotographic process in which occurrence of the above fatigue phenomenon is effectively prevented and charges remained on the composite photosensitive member can effectively be erased.

According to the present invention an electrophotographic process is provided which comprises the steps of providing a composite photosensitive member consisting of at least a conductor, a photoconductive semiconductor layer as a charge generating layer formed on the conductor and a transparent photo semiconductor layer as a charge retentive and transporting layer; forming on the composite photosensitive member an electrostatic latent image corresponding to an image of a document to be copied; obtaining desired duplicated copies with the use of proper developing means and/or transfer means; and exposing ultraviolet rays on the composite photosensitive member.

The desired duplicated copy obtaining step comprises steps of developing the electrostatic latent image as visual image, transferring the developed latent image onto a recording paper and fixing the transferred image onto the recording paper.

The desired duplicated copy obtaining step comprises steps of effecting developing step and transfer step repeatedly until desired numbers of duplicated copies are obtained.

The desired duplicated copy obtaining step comprises steps of transferring the latent image onto an intermediate transfer member, developing the transferred latent image and transferring the developed image onto a recording paper.

The composite photosensitive member is made in a screen shape, a corona ion flow is modulated by the primary latent image formed on the screen shape composite photosensitive member, a secondary electrostatic latent image is transferred onto a recording member, and the ultraviolet ray exposing step is effected after the secondary latent image is formed.

The present invention is formed on the basis of the experiment results that if the composite photosensitive member is exposed to ultraviolet rays after subjecting it to charging and exposure steps as described later, the fatigued phenomenon of the composite photosensitive member can effectively be prevented and thus the initial characteristics can effectively be maintained.

In an electrophotographic process in which duplicated copies are obtained by developing an electrostatic latent image formed on a composite photosensitive member, by visualizing the developed image as toner image and by transferring the toner image onto a recording paper, the above projection step of ultraviolet rays may be effected after transfer of toner image. In an electrophotographic process in which a plurality of duplicated copies are obtained by repeating development and transfer steps without damaging an electrostatic latent image once formed on the composite photosensitive member the projection step of ultraviolet rays may be effected after obtained desired number of duplicated copies, that is, desired number of transfer. In an electrophotographic process in which electrostatic latent image formed on a composite photosensitive member is transferred onto an intermediate transfer member and the latent image transferred onto the intermediate transfer member is developed to transfer the developed image onto the recording paper, the projection step of ultraviolet rays may be effected after transferred the electrostatic latent image onto the intermediate transfer member. In an electrophotographic process in which use is made of screen shaped composite photosensitive member corona ion flow is modulated based on a primary electrostatic latent image formed on the composite photosensitive member and a secondary electrostatic latent image is formed on a recording paper or a transfer member to obtain duplicated copy the projection step of ultraviolet rays may be effected after formed secondary latent image. That is, in any one of electrophotographic processes when the electrostatic latent image formed on the composite photosensitive member is not required the above mentioned projection step of ultraviolet rays may be effected so that in the common electrophotographic process a step of erasing electrostatic latent image after duplicated copy can be combined with a step of projecting ultraviolet rays. The inventor found after various experiments that when charges with polarity of erasing charges of latent image are present on the composite photosensitive member at the time of the projection of ultraviolet rays fatigue recovery effect becomes remarkable.

The ultraviolet ray exposing step is effected after a corona charging having a polarity opposite to that of the latent image is effected to the composite photosensitive member.

The ultraviolet ray exposing step is simultaneously effected with an opposite polarity charging or an AC corona charging.

DETAILED DESCRIPTION OF THE INVENTION

Figure 1:
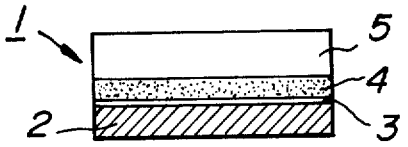
FIG. 1 is a partially cross-sectional view showing a construction of one embodiment of a composite photosensitive member used for carrying out an electrophotographic process according to the present invention.

Referring now to FIG. 1 a construction of one embodiment of a composite photosensitive member used in following experiments according to the present invention is shown. The composite photosensitive member 1 shown in FIG. 1 comprises a conductor 2, an intermediate layer 3, a photoconductive semiconductor layer 4 and a transparent photo semiconductor 5 which are stacked on the conductor 2 in order. The conductor 2 may be used a metal plate or a conductor formed by depositing metal such as At, Pb, Cu or the like on a surface of an insulating material such as an organic film or by coating a conductive material on the surface of the insulator and by subjecting the result assembly to a conducting process. The intermediate layer 3 serves to increase an adhesive force of the conductor 2 to the photoconductive semiconductor layer 4 and to decrease dark decay by electrical barriers formed by both junctions thereof. The layer 3 is formed by an organic insulating material or a high resistive semiconductor material. The photoconductive semiconductor layer 4 is formed by depositing inorganic photoconductive semiconductor material having a thickness of less than few $\mu$ and consisting of mainly amorphous Se on the intermediate layer 3. The amorphous Se may be included Te of less than 35 weight percent or mixed metals such as As, Sb, Bi, Cd or the like therein in order to improve light sensitivity and color sensitivity. The transparent photo semiconductor layer 5 is formed by a material having charge retentive function and photocharge transporting function. Typical embodiments of transparent photo semiconductive material having these functions are as follows.

(a) polyvinylcarbazoles (PVK) poly-N-vinylcarbazole, poly-N-vinylcarbazole chloride and poly-N-vinylcarbazole bromide
(b) vinyl polymer copolymers which are described in Japanese Patent Application Publication Nos. 8,553/66, 14,110/67, 18,674/67 and 1,553/68, and polyvinyl acridine, polyvinyl naphthalene, polyvinyl anthracene, polyvinyl pyrazoline or the like and its nitro compounds.
(c) aromatic carboxylic acid or its anhydrous nitro-substituted compound
(d) aromatic nitro compound of benzene, naphthalene or anthracene other than carboxylic acid
(e) nitro compound of aromatic heterocyclic compound
(f) quinones A certaine sensitizer may be added or mixed to the transparent photo semiconductor material in order to chemically or optically increase sensitivity. Chemical sensitizers are as follows;

(1) halogenide of stannous chloride, zinc chloride etc.,
(2) carboxylic acid,
(3) organic sulfonic acid,
(4) ketones and
(5) aromatic nitro compound (nitrofluorenone compound). Optical sensitizers are as follows.
(1) dyes,
(2) pyrylium salt, thiopyrylium salt and
(3) carbonium salt.

In order to intensity formation of the transparent photo semiconductor layer 5 reinforce, plasticizing agent such as polycarbonate resin, epoxy resin, diphenyl chloride can be mixed in the transparent photo semiconductor materials.

EXPERIMENT 1

Use is made of as the conductor 2 Al plate which is sufficiently subjected to a fat removing treatment and Parylene (trade name) having thickness of 0.2$\mu$ is deposited on the Al plate to form the intermediate layer 3. The amorphous Se including Te of 9 weight percent and having thickness of 0.5$\mu$ is deposited on the layer 3 at 60° C. of substrate temperature in a vacuum of $2\times10^{-5}$ Torr to form the photoconductive semiconductor layer 4. A mixed solution of 8 gram-weight of polyvinylcarbazole (made by BASF Company, LUVICAN M-170), 100 gram-weight of monochlorobenzone, and 50 gram-weight of dichloromethane is spread on the layer 4 and dried at temperature of 50° C. by one hour resulting in formation of the transparent photo semiconductor layer 5 having thickness of 28$\mu$ thereby to obtain the composite photosensitive member 1. This composite photosensitive member 1 is referred to a composite photosensitive member A hereinafter.

Figure 2:
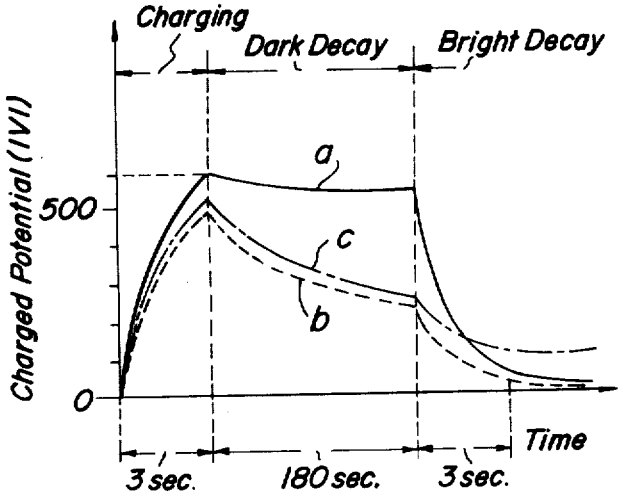
FIGS. 2, 3 and 4 are graphs showing results of various experiments performed with the use of the composite photosensitive member shown in FIG. 1.

The composite photosensitive member A is charged at 600 V with negative polarity and its dark decay and bright decay characteristics are investigated and shown in FIG. 2 by a curve a. In FIG. 2 abscissa is plotted by time (sec) and ordinate is plotted by charged potential ($|V|$). As is shown in FIG. 2 the amount of the dark decay was very small and about 5–8% during 180 sec.

Next, a composite photosensitive member is formed by the same material and construction as the above composite photosensitive member A except that the intermediate layer 3 is absent and referred to a composite photosensitive member B hereinafter. The decay characteristics of the composite photosensitive member B are investigated in the same manner as the photosensitive member A and shown in FIG. 2 by a curve b. As is seen from the curve b the amount of the dark decay of the photosensitive member B is very large and about 50% during 180 sec. It is found from the curves a and b that the intermediate layer 3 plays an important role to decrease the dark decay.

Then, the composite photosensitive members A and B are repeatedly charged with negative polarity and exposed and its decay characteristics are investigated and shown in FIG. 2 by a curve c. It is found from the curve c that for the photosensitive member A the charged potential is decreased, the dark decay is abruptly increased and the residual potential is increased. On the contrary the decay characteristics of the composite photosensitive member B are scarcely changed as compared with the initial decay characteristics even after repeated the charging and exposure steps. In this experiment the used illuminating device for exposure is a tungsten lamp having illumination of about 15 lux.

EXPERIMENT 2

In this experiment the materials of the conductor 2 and the thickness of the intermediate layer 3 of the composite photosensitive member A shown in the experiment 1 are preferably exchanged with each other and combined to form various composite photosensitive members in order to investigate the differences of the residual potential and the dark decay due to the electrical barrier. That is, the conductor 2 is formed by a stainless steel plate, aluminum plate or a plastic plate deposited with an aluminum film, a palladium film or a titanium oxide film. The intermediate layer 3 is formed by epoxy resin, silicone resin, polyurethane resin, etc. instead of Parylene. The decay characteristics of the composite photosensitive members thus formed are investigated respectively in the same manner as the experiment 1. It is found from this investigation that the dark decay rate and the residual potential are changed depending on the combination of the materials and the thickness of the intermediate layer 3. With regard to the thickness of the intermediate layer 3 in all composite photosensitive members if the thickness of the layer 3 is made large the dark decay is decreased and the residual potential is increased.

Figure 3:
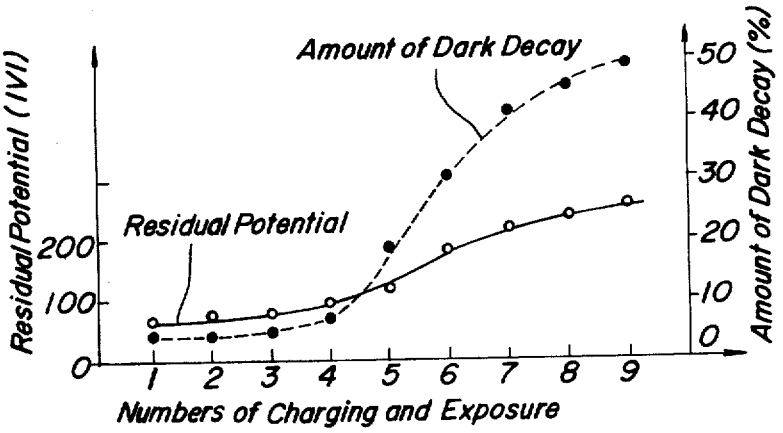

These composite photosensitive members are repeatedly subjected to charging and exposure steps, respectively, and its decay chracteristics are investigated each time in the same manner as the experiment 1. As the result of this it is found that both the dark decay and the residual potential of all composite photosensitive members are remarkably increased. The amount of the dark decay and the residual potential of one composite photosensitive member are shown in FIG. 3. In this figure abscissa is plotted by residual potential ($|V|$) and the amount of dark decay (%) and ordinate is plotted by the numbers of charging and exposure steps. As is seen from FIG. 3 it is found that the amount of the dark decay characteristic is largely changed from the initial characteristic with only seven times of charging and the exposure step.

EXPERIMENT 3

Each of various composite photosensitive members having the intermediate layer 3 used in the experiments 1 and 2 is fatigued by repeatedly subjecting to the charging (with negative polarity) and the exposure steps and kept in the dark place about 30 minutes and more and then the decay characteristics are measured and investigated. As the result of this it is found that the restoration for the fatigue phenomenon, that is, the decrease of the charged potential and the increases of the dark decay and the residual potential for all composite photosensitive member can not be recognized.

EXPERIMENT 4

Each of all composite photosensitive members is exposed to ultraviolet rays having dominant wavelength of 360 nm radiated from a mercury lamp of 10 W with a filter for eliminating visible light at a distance of 30 cm or to ultraviolet rays radiated from a fluorescent lamp type germicidal lamp of 15 W at a distance of 30 cm and after confirmed that the residual potential becomes zero volt the composite photosensitive member is again subjected to the charging and the exposure steps and then its decay characteristics are investigated. As a result of this the fatigue of all composite photosensitive member is almost recovered and the initial decay characteristics can be obtained.

EXPERIMENT 5

Each of all composite photosensitive members is subjected to a corona charging step with positive polarity and then exposed to ultraviolet rays described in the experiment 4 during 0.5–1 sec. As a result of this the residual potential of all composte photosensitive members becomes zero volt at once the transparent photosensitive member 5 of polyvinylcarbazole becomes photoconductive by the exposure of ultraviolet rays resulting in abrupt decay of charged potential and the charges stored therein are erased by neutralization or recombination with charges of opposite polarity. In this experiment charge amount of corona charging with opposite polarity is substantially equal to sum of charges with negative polarity charged until the fatigue is generated. Each of all composite photosensitive members in which the residual potential has been become zero volt, is then subjected to the charging and the exposure steps in the same manner as the experiment 1 and its decay characteristics are measured and investigated. As a result of this for all composite photosensitive members the above described fatigue phenomenon disappears so that the charged potential, the dark decay and the residual potential are restored to the initial values thereof.

EXPERIMENT 6

Figure 4:
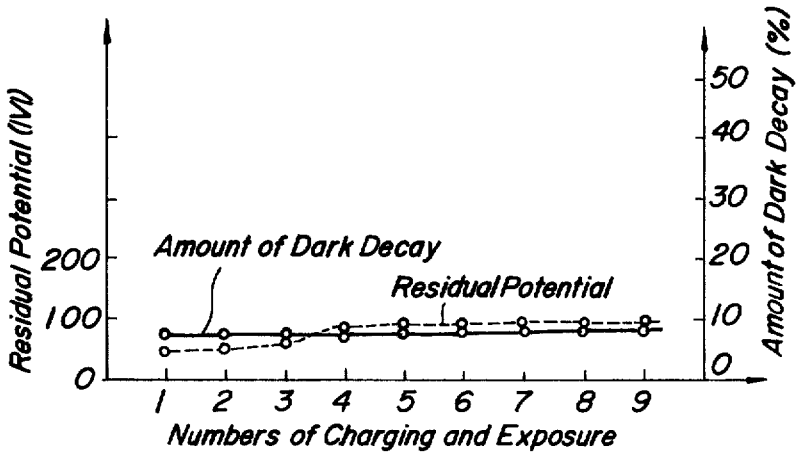

The composite photosensitive member A shown in the experiment 1 is charged to a voltage of 600 V with negative polarity and then exposed to a light of about 15 lux. As a result of this the residual potential is about 40 V. The composite photosensitive member A is then charged to 600 V with negative polarity and exposed to the ultraviolet rays described in the experiment 4 so that the residual potential becomes zero volt. The composite photosensitive member A is then subjected to a series of the above four steps repeatedly and as a result the fatigue phenomenon does not occur and the initial decay characteristics can be maintained. FIG. 4 is a graph showing results in which in the above repeated experiments the composite photosensitive members are exposed to a visible light and then the residual potential and the amount of dark decay after charged at 600 V are measured. In this figure ordinate is plotted by the residual potential and the amount of dark decay and abscissa is plotted by the numbers of charging and exposure steps.

As is seen from the above experiments 1 to 6 if the composite photosensitive member in which the fatigue occurs by repeated charging and exposure steps, is exposed to ultraviolet rays the restoration of the fatigue can be made very fast and if the composite photosensitive member is exposed to ultraviolet rays after charged with opposite polarity the effects thereof becomes further remarkable, so that the effects of the barrier due to the intermediate layer 3 can effectively be utilized without occurrence of the abuse (the increase of the residual potential). There is also an advantageous effect in which the ultraviolet rays injection, particularly, the ultraviolet rays injection with opposite polarity charging release charges trapped in the photoconductive semiconductor layer and the transparent photo semiconductor layer, so that the dark decay caused by the trapped charges can be made very small. The polyvinylcarbazole (the transparent photo semiconductor layer) used in the above experiments exhibits a rectification characteristic for visible light so that positive hole may be transported and electron may not be transported. That is, the transparent photo semiconductor layer charged with positive polarity does not exhibit a photoconductivity for visible light so that in the actual electrophotographic apparatus electrostatic latent image having negative polarity is utilized. In such composite photosensitive member if electrons are once trapped they can not be released by visible light so that the fatigue can not be restored. If the sensitizer such as dye is doped into the transparent photo semiconductor layer to release charges trapped by visible light, that is, to have sensitivity in the visible region the sensitivity of whole composite photosensitive member is decreased and the dark decay is increased so that it is preferable to avoid such doping. As is seen from the above experiments if polyvinylcarbazole is exposed to ultraviolet rays it has sensitivity with the charges of not only negative polarity but also positive polarity so that it is activated by ultraviolet rays and thus the trapped electrons are effectively released. The present invention, therefore, utilizes the characteristic that organic transparent photo semiconductor such as polyvinylcarbazole has sensitivity with ultraviolet rays, so that when electrostatic latent image formed on the composite photosensitive member is not used the member is exposed to ultraviolet rays to be able to restore the characteristics of the composite photosensitive member to its initial characteristics and thus the above fatigue phenomenon can be prevented. The electrons can be released faster with the use of charges having opposite polarity to that of trapped electrons when activated by exposing ultraviolet rays to the composite photosensitive member. In the present invention, therefore, ultraviolet rays are exposed to the composite photosensitive member after the corona charge having opposite polarity to that of the latent image or at the same time with charging of opposite polarity of AC corona charging. In the above experiments the transparent photo semiconductor layer is formed by polyvinylcarbazole and the photoconductive semiconductor layer is formed by amorphous Se including Te, but these layers may be formed other materials. The composite photosensitive layer may also be constructed by other construction.

Figure 5:
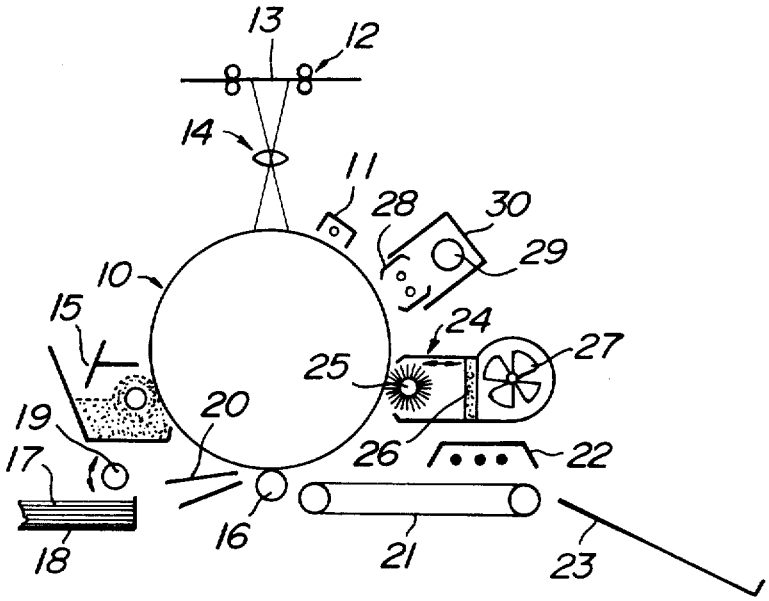
FIGS. 5 and 6 are diagrams showing construction of apparatuses for carrying out the process according to the present invention.
Figure 6:
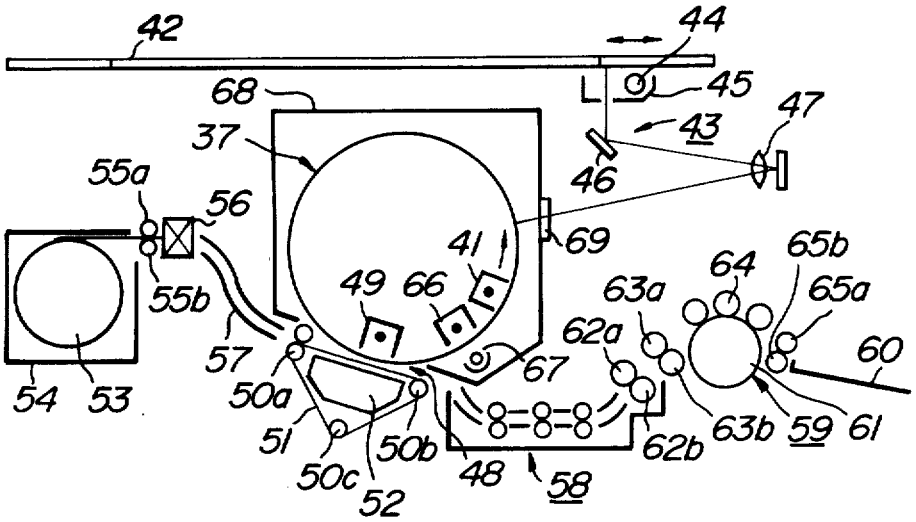

Two embodiments of an apparatus for carrying out the electrophotographic process according to the invention will be shown in FIGS. 5 and 6.

The electrophotographic apparatus shown in FIG. 5 is based on a Carlson system. In this embodiment, on a substrate drum consisting of Al or stainless steel are successively laminated on intermediate layer, photoconductive semiconductor layer and transparent photo semiconductor layer, each consisting of the same material as that for constructing a composite photosensitive member A described in Experiment 1, or on a plastic film or the like are successively laminated a conductive layer, intermediate layer, photoconductive semiconductor layer and transparent photo semiconductor layer, each consisting of the same material as that for constructing the composite photosensitive member A in the same manner, the thus laminating layer is wound around a drum-like substrate by winding the transparent photo semiconductor layer at the outermost side, and is composed of a drum-like composite photosensitive member 10 which is rotatable in the direction of an arrow. In general, in the electrophotographic apparatus which employs the Carlson system, after an electrostatic latent image formed on the photosensitive member by one exposure is developed to a toner image, this toner image is transferred to a recording paper and one duplicated copy is obtained. The charge retentive ability of this photosensitive member is commonly small and has a dark decay of 30–40% for 1 minute. On the other hand, the composite sensitive member 10 used in the present embodiment is constructed in the same manner as in Experiment 1, and its initial decay characteristic is dark decay of 5–8% for 3 minutes (0–8% for 1 minute). A plurality of duplicated copies, therefore, can be obtained by repeating development step to a toner image and a transfer step to a recording paper based on an electrostatic latent image once formed on the composite photosensitive member 10.

In the electrophotographic apparatus shown in FIG. 5, the composite photosensitive member is firstly rotated, and its surface is uniformly negative charged to 400–1,000 V by means of a first corona charger 11 applied a negative voltage of 6–10 KV thereto. Then, to this composite photosensitive member 10 is irradiated a light image of a document 13 scanned by a document scanning device 12 through a projecting optical system 14, and an electrostatic latent image corresponding to this light image is formed thereon. The electrostatic latent image is visualized into a toner image by rotating the composite photosensitive member 10 and by means of a developing device 15 arranged around the outer periphery. As a developing method of the electrostatic latent image, use may be made of a magnet brush method, a dry-type developing method such as a cascade method and the like, a wet-type developing method and the like. The wet-type developing method is liable to deteriorate a characteristic of a duplicated copy in case of copying a plurality of copies by one exposure, i.e., in case of obtaining a plurality of duplicating copies based on a single electrostatic latent image formed by one exposure, so that the present embodiment employs the magnet brush developing method. A toner image formed on the composite photosensitive member 10 is duplicated into a recording paper between the composite photosensitive member 10 a bias transferring roller 16 made into contact with the composite photosensitive member 10 and applied a negative polarity voltage thereto. As a transfer means of a toner image, mention may be made of a corona discharge transfer system in addition to a biased roller transfer system, but this corona discharge transfer system is good at transfer efficiency but easily breaks an electrostatic latent image. Therefore, in case of effectively transferring a plurality of copies, this system is improper. In addition, in the biased roller transfer system, if a biased transfer roller 16 is properly pressed to the composite photosensitive member 10, the efficient transfer can be carried out.

A recording paper 17 is laminated within a cassette 18, synchronized with rotation of the composite photosensitive member 10, taken up one by one by means of a pickup roller 19, and transferred between the composite photosensitive member 10 and the biased transfer roller 17 through a paper guide 20. In addition, the recording paper is used by cutting roll paper into a predetermined length. The recording paper to which a toner image is transferred is peeled off from the composite photosensitive member 10, the toner image is fused by the fixing action of a fixing device 22 on a conveying belt 21 and exhausted as a final duplicated image into a tray 23. The fixing device 22 is of a heat fixing method by an open heater in the present embodiment, but a flush fixing method, a press fixing method and the like can be employed.

The composite photosensitive member 10 after the toner image is transferred is cleaned by a cleaning device 24 so as to remove any adhered material such as a toner, solvent and the like remained on the surface. The cleaning device 24 is composed of a cleaning brush 25 detachable to the composite photosensitive member 10, a filter 26 and a suction fan 27 in the present embodiment.

The thus cleaned composite photosensitive member 10 is exposed to ultraviolet rays which is a characteristic of the electrophotographic process according to the present invention, but in the present embodiment, not only irradiation of ultraviolet rays but also corona charge of porality (positive porality) opposite to that of the electrostatic latent image remained on the composite photosensitive member 10 are carried out. In addition, a charge amount of opposite porality charge is almost equal to a charge amount of the first corona charger 11. Therefore, in opposition to the composite photosensitive member 10 is arranged a second corona charger 28 applied a positive polarity voltage of 6–10 KV thereto, and through this second corona charger 28 is arranged a light source 29 of ultraviolet rays for projecting ultraviolet rays to the composite photosensitive member 10 through the second corona charger 28. Further, in order not to project ultraviolet rays from the light source 29 to any unnecessary portion, the light source 29 is enclosed with an enclosure 30. Both the irradiation of ultraviolet rays and the opposite polarity charge are simultaneously carried out, so that the electrostatic latent image remained on the composite photosensitive member 10 is effectively erased, the composite photosensitive member 10 is restored to the initial state (characteristic) and preparation for forming the next electrostatic latent image can be completed. In addition, it is a matter of course that this process is possibly by only irradiating ultraviolet rays, but in case of combining with the above opposite polarity charging, after the opposite polarity charged, ultraviolet rays can be irradiated, or instead of the opposite polarity charging, AC corona charging and irradiation of ultraviolet rays can be simultaneously carried out. Further, in either case, both the irradiation of ultraviolet rays and the irradiation of visible light can simultaneously be carried out. Further, this process performs a function similar to that of the cleaning device 24, so that such irradition can be carried out immediately before and simultaneously with the cleaning process.

In the electrophotographic apparatus shown in FIG. 5, in case of obtaining a plurality of duplicated images based on an electrostatic latent image once formed on the composite photosensitive member 10, after forming the electrostatic latent image, the developing and transferring steps are only repeated as desired, and thereafter the above-described cleaning device 24, the second corona charger 28 and the ultraviolet ray light source 29 are actuated. In addition, in the present embodiment, the contrast of the electrostatic latent image lowered as the increase of the number of transfer step can be compensated by controlling a voltage applied to the biased transfer roller 16.

In the electrophotographic apparatus comprising the above-described construction, as a result of obtaining duplicated images of various documents, the image quality thereof is very excellent. Further, in the plural duplication, clear 50–60 copies can be obtained without lowering the contrast and causing a fog of the background, i.e., within the range of sensing no change of picture quality.

The electrophotographic apparatus shown in FIG. 6 employs an ion flow control system. This system is to obtain a duplicated image with the use of a photoconductive screen having a number of fine openings, wherein a corona ion flow is modulated on the basis of a first electrostatic latent image formed on the screen, a second electrostatic latent image is formed on the recording paper and this second electrostatic latent image is visualized into a toner image.

The electrophotographic method with the use of a photoconductive screen is described in U.S. Pat. Nos. 3,680,954, 3,220,324, etc., and publicly known. In Japanese Patent Laid-open No. 60,527/76 and Japanese Patent Application Publication No. 341/76, the electrophotographic apparatus with the use of a photoconductive screen having the three layer structure is described, while U.S. Pat. No. 3,713,734 describes the electrophotographic method with the use of a photoconductive screen having the four layer structure.

In the electrophotographic apparatus shown in FIG. 6, the photoconductive screen is composed of a composite photosensitive member which is rotatably extended in the direction of an arrow in the shape of a drum. Two embodiments of the photoconductive screen composed of the composite photosensitive member are shown in FIGS. 7 and 8 in cross-section.

Figure 7:
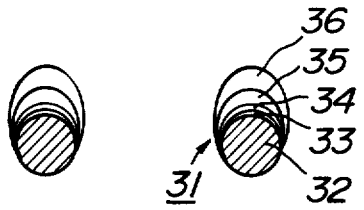
FIGS. 7 and 8 are cross-sectional views showing construction of photoconductive screens used in the apparatuses shown in FIG. 6.
Figure 8:
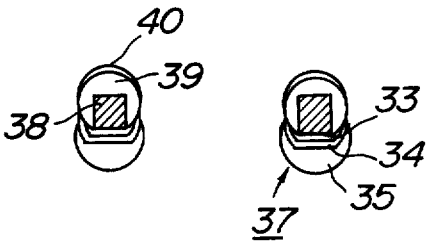

A photoconductive screen 31 shown in FIG. 7 is constructed in such a manner that at least one surface side of a conductive mesh member 32 having 100–400 meshes, preferably 200–300 meshes, is exposed, an intermediate layer 33 consisting of Parylene, a photoconductive semiconductor layer 34 consisting of Se-Te and a transparent photo semiconductor layer 35 consisting of polyvinylcarbazol are successively laminated to make a thickness of all the three layers 10–20$\mu$, and on the transparent photo semiconductor layer 35 is further laminated an insulating layer 36 having a thickness of 5–30$\mu$. Further, a photoconductive screen 37 shown in FIG. 8 is constructed in such a manner that an insulating layer 39 having a thickness of 15–20$\mu$ is laminated to remain at least one surface side of a conductive mesh member 38 having 100–400 meshes, preferably 200–300 meshes, a conductive layer 40 is formed on the insulating layer 39 by depositing Al, and for covering the remained surface side, an intermediate layer 33 consisting of the same material as that of the photoconductive screen shown in FIG. 7, a photoconductive semiconductor layer 34 and a transparent photo semiconductor layer 35 are successively laminated to make a thickness of all the three layers 5–30$\mu$. The electrophotographic process according to the invention can use both the photoconductive screens 31 and 37 shown in FIGS. 7 and 8, but in the electrophotographci apparatus shown in FIG. 6, the photoconductive screen 37 shown in FIG. 8 is used and extended rotatably in the direction of an arrow by providing the insulating layer 36 at the outermost side.

In FIG. 6, at first, the conductive layer 40 (refer to FIG. 8) of the drum-like photoconductive screen 37 is maintained at 250 V of a negative potential, and the outer peripheral surface of the photoconductive screen 37 is uniformly negative charged to −250 V by means of the first corona charger 41 arranged in the drum. Then onto the photoconductive screen 37 is projected a light image of document (not shown) placed on a document table 42 which is reciprocally movable in the directions of both arrows by synchronizing with the rotation of the screen 37 through an optical system 43, and a primary electrostatic latent image corresponding to the light image is formed thereon. The optical system 43 is composed of an illuminating lamp 44, a light source mirror 45, a reflection mirror 46 and a projection lens 47 in the present embodiment. In addition, there is another construction such that the document table 42 is fixed, the optical system 43 is moved by synchronizing with the rotation of the photoconductive screen 37 and a document image is projected.

The photoconductive screen 37 on which the primary electrostatic latent image is maintained is further rotated so as to receive projection of a corona flow of the positive polarity from a second corona charger 49 arranged at a secondary electrostatic latent image forming position 48 and the inner side of the drum through the photoconductive screen 37. On the secondary electrostatic latent image forming position 48 is positioned a conveying belt 41 co-used as a back plate and driven by three rollers **50*a*, 50*b* and 50*c* through these second corona charger 49 and the photoconductive screen 37, while in the inner side of the conveying belt 51 is provided a vacuum suction device 52 for carrying a recording paper conveyed by synchronizing with the rotation of the photoconductive screen 37 by effectively contacting with the conveying belt 51. The corona ion flow of the positive polarity projected from the second corona charger 49 is modulated by the primary electrostatic latent image on the photoconductive screen 37, thereby forming a secondary electrostatic latent image consisting of positive charges corresponding to the primary electrostatic latent image on the recording paper conveyed on the conveying belt 41. In addition, during this secondary electrostatic latent image is formed, a potential of the conductive layer 40 (refer to FIG. 8**) is −100 V to −150 V.

The recording paper for forming the secondary electrostatic latent image is roll-shaped in the present embodiment. This roll recording paper 53 is put in the cassette 54, synchronized with the rotation of the photoconductive screen 37, taken up by a pair of rollers 55*a* and 55*b*, cut into a predetermined length by a cutter 56, conveyed onto the conveying belt 51 through a paper guide 57, and formed into a secondary electrostatic latent image. Further, in case of using a sheet-like recording paper, it is preferable to carry it out in the same manner as in the electrophotographic apparatus shown in FIG. 5.

The recording paper on which the secondary electrostatic latent image is formed is exhausted as a final duplicated image into a tray 60 through the developing device 53 and the fixing device 59. The developing device 58 and the fixing device 59, as explained in FIG. 5, can be any one of various systems, but in the present embodiment, as the developing device 58 a wet-type developing system, as the fixing device 59 a dry fixing system with the use of a dry roller 61 are employed, respectively. In FIG. 6, therefore, the recording paper on which the secondary electrostatic latent image is formed is wet developed, guided around the outer periphery of the dry roller 61 through a pair of throttle rollers 62*a*, 62*b* and a pair of suction rollers 63*a*, 63*b* by a plurality of guide rollers 64, and exhausted to the tray 60 through a pair of exhausted paper rollers 65*a*, 65*b*.

After completion of the formation of the secondary electrostatic latent image on the recording paper the primary electrostatic latent image maintained on the photoconductive screen 37 is erased the preparation for forming the next primary electrostatic latent image is completed. The primary electrostatic latent image is erased by simultaneously actuating the third corona charger 66 for opposite porality (positive porality) charging almost equal to the charge amount by the first corona charger 41 arranged in the inside of the drum and the ultraviolet ray light source 67 such as a fluorescent lamp or the like oppositely arranged through the photoconductive screen 37. Thus, if ultraviolet rays are simultaneously irradiated with the charge of the opposite porality maintained on the photoconductive screen 37, the photoconductive screen 37 can be restored to the initial state (characteristic). In addition, the third corona charger 66 can be arranged on the side of the ultraviolet ray light source 67. Further, the primary electrostatic latent image can be erased by irradiating ultraviolet rays after the opposite porality charging, at the same time with AC corona charging or only irradiation of ultraviolet rays, as explained in FIG. 5.

In the electrophotographic apparatus shown in FIG. 6, in order to protect the photoconductive screen 37 from open light, the screen is enclosed with a shielding member 68 except the secondary electrostatic latent image forming position and an exposure window 69 is provided at a light path portion for projecting a light image.

In the aforementioned electrophotographic apparatus, in case of obtaining a plurality of duplicated images based on the primary electrostatic latent image once formed on the photoconductive screen 37, after the primary electrostatic latent image is formed, the photoconductive screen 37 is rotated as desired and repeated the secondary electrostatic image forming step by the second corona charger 49, the developing step and the fixing step as desired, thereafter, third third corona charger 66 and the ultraviolet ray light source 67 are actuated. In this case, a potential of the conductive layer 40 is preferably automatically adjusted by corresponding to a change of the contrast of the primary electrostatic latent image.

The electrophotographic apparatus shown in FIG. 6 is tried to obtain one copy or a plurality of copies from various documents, and as a result, a duplicated image of good quality can be obtained.

As described above, the present invention utilizes such characteristics that a transparent photo semiconductor having charge retentive and transportion function for constructing a composite photosensitive member shows photoconductivity to ultraviolet rays. A composite photosensitive member fatigued by repeating charging and exposure steps is variously treated inclusive of ultraviolet ray irradiation, and as a result, it is found that the composite photosensitive member can be recovered to the initial characteristic, so that at the time of completing the electrostatic latent image formed on the composite photosensitive member its role, ultraviolet ray irradiation is carried out on the composite photosensitive member or simultaneously or after the charging acting as erasing the electrostatic latent image, and as a result, the composite photosensitive member can always be used under the initial characteristic state, and a duplicated copy of good quality can be obtained without lowering the image quality caused by a fatigue phenomenon.

The invention is not limited to the above embodiments, but variously modified. For example, in the electrophotographic apparatus shown in FIGS. 5 and 6, the electrostatic latent image (the primary electrostatic latent image in FIG. 6) is erased by a well known erasing means, i.e., a light source for projecting visible light or a corona charger for erasing charges on the composite photosensitive member, or a combination thereof, and thereafter irradiated ultraviolet rays. In such a manner, the irradiation of ultraviolet rays is not carried out every duplicating step for one document but after finishing the duplicating step for a predetermined number of copies, or previously carried out before the duplicating step. Further, the electrophotographic apparatus shown in FIGS. 5 and 6 can be composed of the composite photosensitive member 10 and a sheet-like photoconductive screen 37. Further, the electrophotographic apparatus shown in FIG. 6 can form a secondary electrostatic latent image in an intermediate transfer member, develop it into a toner image as well as the electrophotographic apparatus shown in FIG. 5 and transfer to a recording paper and obtain a duplicated copy.

What is claimed is:

1. In an electrophotographic process by the Carlson method, said method employing a composite photosensitive member including an electrically conductive supporting body, an intermediate layer of organic insulator for preventing charges from being injected from said supporting body, a photoconductive semiconductor layer having a charge generating function, and a transparent photo semiconductor layer having charge retentive and transporting functions, said layers being in the form of a stack in the recited order; and including the steps of uniformly charging said composite photosensitive member in one polarity; projecting a visible light image of a document to be copied to form an electrostatic latent image on the composite photosensitive member; developing the latent image with toners to form a toner image; transferring the toner image onto a record medium to form a copy; and erasing said electrostatic latent image after a plurality of copies have been formed from the same and single electrostatic latent image by repeating said developing and transferring, the improvement comprising:

uniformly charging the composite photosensitive member in an opposite polarity and irradiating the composite photosensitive member with ultraviolet rays simultaneously with or immediately after said charging step to release charges trapped in the photoconductive semiconductor layer and the photo semiconductor layer of said composite member, said charges having been generated in the photoconductive semiconductor layer and the photo semiconductor layer during a duplication of a plurality of copies.

2. An electrophotographic process according to claim 1, wherein said irradiating with ultraviolet rays and said uniformly charging in the opposite polarity are effected after said electrostatic latent image has been erased.

3. An electrophotographic process according to claim 1, wherein said photo semiconductor layer is formed by polyvinylcarbazole through which positive charges can be transported under irradiation with the visible image and said uniformly charging in one polarity and in the other polarity are effected in negative and positive polarities, respectively, to release and neutralize, with the positive charges on the photo semiconductor layer, negative charges trapped in the photoconductive semiconductor layer.

* * * * *